United States Patent [19]

Lenza

[11] 3,949,518

[45] Apr. 13, 1976

[54] MISSILE LAUNCHING TOY

[76] Inventor: Vincent V. Lenza, 90 Montgomery Ave., Staten Island, N.Y. 10301

[22] Filed: July 21, 1975

[21] Appl. No.: 597,581

[52] U.S. Cl. ..... 46/74 B; 124/16; 124/21

[51] Int. Cl.[2] ..... A63H 27/00

[58] Field of Search ..... 46/74 B; 124/16, 21

[56] References Cited

UNITED STATES PATENTS

| | | | |
|---|---|---|---|
| 2,891,795 | 6/1959 | Glintz | 124/16 |
| 2,993,297 | 7/1961 | Bednar et al. | 46/74 B |
| 3,088,450 | 5/1963 | Clay | 46/74 B |
| 3,612,027 | 10/1971 | Makino | 124/16 |
| 3,635,204 | 1/1972 | Plumb | 124/16 |

*Primary Examiner*—Louis G. Mancene
*Assistant Examiner*—Robert F. Cutting

[57] ABSTRACT

A missile launching toy wherein twirling the body in one hand causes rotation of a head within a cylinder by an angularly disposed counterweight fixed to the head but extending outside the cylinder to provide stored energy by compressing a spring or air to launch on release the missile which is shown as an elongated projectile or a stabilized balloon.

8 Claims, 7 Drawing Figures

MISSILE LAUNCHING TOY

SUMMARY OF INVENTION

This invention relates to new and useful improvements in missile launching toys and more particularly, seeks to provide a hollow cylinder adapted to fit in and be twirled by one hand which causes rotation of a head through rotation of an integral handle extending out of the cylinder and being angularly disposed to thus move the head upwardly to compress a spring, air or other energy storage element that is subsequently used to launch a missile such as a projectile, balloon, etc.

OBJECTS OF THE INVENTION

It is an object of this invention to provide a simple hand toy that young children can use to launch missiles by merely placing the missile in the launcher and twirling the body of the toy.

It is a further object to provide a toy, the use of which can be easily repeated while the hollow cylinder is held in the child's hands.

With these and other objects, the nature of which will be apparent, the invention will be more fully understood by reference to the drawings, the accompanying detailed description, and the appended claims.

DESCRIPTION OF THE PREFERRED EMBODIMENTS

Figure 1:
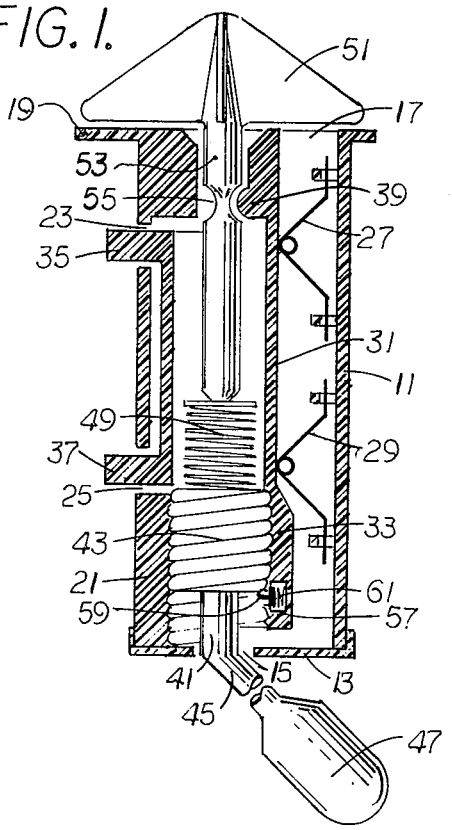
FIG. 1 is a vertical section through a toy with the spring compressed and the missile ready to be released, constructed in accordance with this invention.
Figure 1:
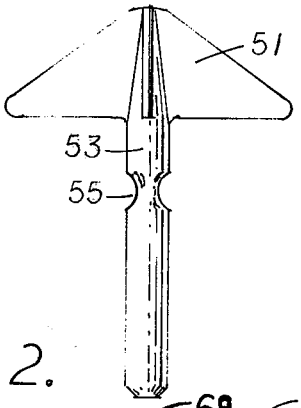

Referring to the drawings in detail, the invention, as illustrated, is embodied in a missile launcher toy, which includes a hollow tubular body 11 of a size which can be conveniently gripped and twirled in one hand, provided with a bottom end closure cap 13 having a port 15 and a top opening 17 surrounded by a shoulder flange 19. The body 11 is provided with a semi-circular interior female threaded portion 21 at one side of its lowermost end, adjacent bottom end closure cap 13, with lateral ports 23, 25 to accommodate protruding operating buttons, and with resilient elements such as, springs 27, 29 mounted interiorly of the body, one adjacent each end thereof.

A hollow tubular form or barrel 31 is arranged epicentrically interiorly of the body 11 and is formed or provided with a semicircular interior female threaded portion 33, having threads of gauge and pitch to match the threaded portion 21, a launch button 35, and a reset button 37, disposed to protrude respectively through lateral ports 23 and 25 of body 11. As shown in the drawings, the generally overall tubular form of barrel 31 is cut or formed to approximate semi-circular cross sections at each end, the lower half-tubular section extending below the location of the reset button 37 comprising the threaded portion 33 and the upper half-tubular section extending above the location of the launch button 35 and mounting a missile launch lock protrusion 39, extending interiorly to engage a matching recess 55 on the missile shaft.

Figure 2:
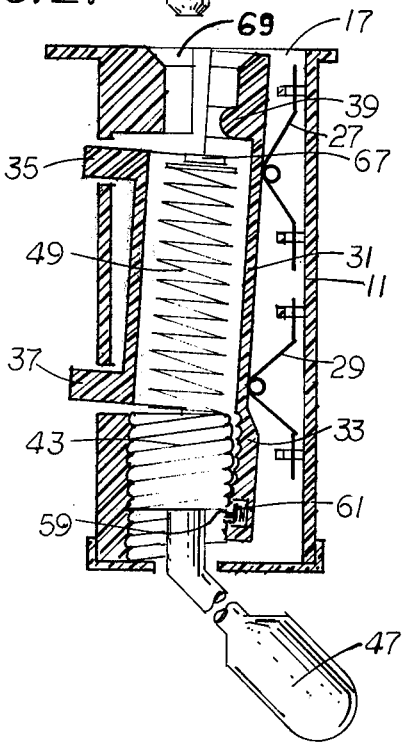
FIG. 2 is a vertical section just after release of said missile.
Figure 3:
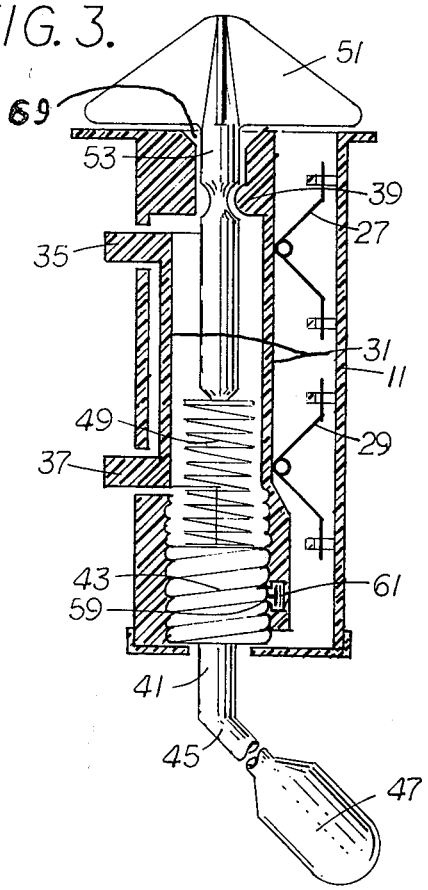
FIG. 3 is a verticle section after reloading of said missile but before spring compression.
Figure 4:
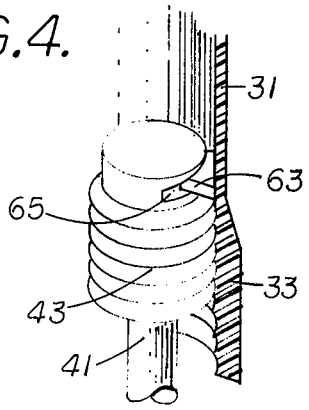
FIG. 4 is an enlarged perspective view of a modified locking member for the threaded rotating head.

The energy imparting element of the embodiment shown comprises a shaft 41 provided with a male threaded head end 43, having threads of a gauge and pitch to engage the female threads of body and barrel portions 21 and 33, respectively, an arm 45 fixedly attached to and extending angularly from the lower extremity of shaft 41, and a counterweight 47 integral to arm 45. A locking mechanism for FIGS. 1 to 3 is shown as well 57 in barrel 31 enclosing a locking pawl 59 and pawl spring 61. When barrel 31 is vertical, head 43 is locked above pawl 59 after clearing same. However, once 31 moves to the right as shown in FIG. 2, the head can be threaded downwardly past pawl 59. As shown in FIG. 4, a modified head 43 has a groove 65 which engages barrel locking protrusion 63, when the head has moved upwardly to the proper point but only as long as barrel 31 is vertical.

Mounted above the male head 43 is a compressible spring 49 with an associated retainer 67 affixed to barrel 31. The free end of missile shaft 53 rides on the upper end plate of spring 49. The shaft has an intermediate recess 55 and four vanes 51 at the head end.

The body 11 is rapidly twirled by moving the hand holding same about a short radius through a circle of 6 to 12 inches diameter, which causes counterweight 47 to rotate the head 43 until it is at the bottom of body 11 as seen in FIG. 3. The missile shaft is then placed through the top opening 69 against spring 49 and the reset button 37 is pushed to the right so that barrel 31 is vertical, and launch lock protrusion 39 engages recess 55 to hold the missile in locked but uncharged position as shown in FIG. 3. Counterweight 47 is caused to rotate in the opposite direction by twirling body 11 until the head 43 passes pawl 59 to compress spring 49 and store energy therein, at which time the pawl is spring-driven toward the shaft 41 to lock the head 43 at the uppermost position shown in FIG. 1. At this point, the launch button 35 is pressed to the right, releasing the missile 53, which is forced upwardly by the compressed spring 49 as shown in FIG. 2 immediately after release.

Thereafter, the procedure for reloading and refiring is repeated sequentially through FIGS. 3, 1 and 2.

Figure 5:
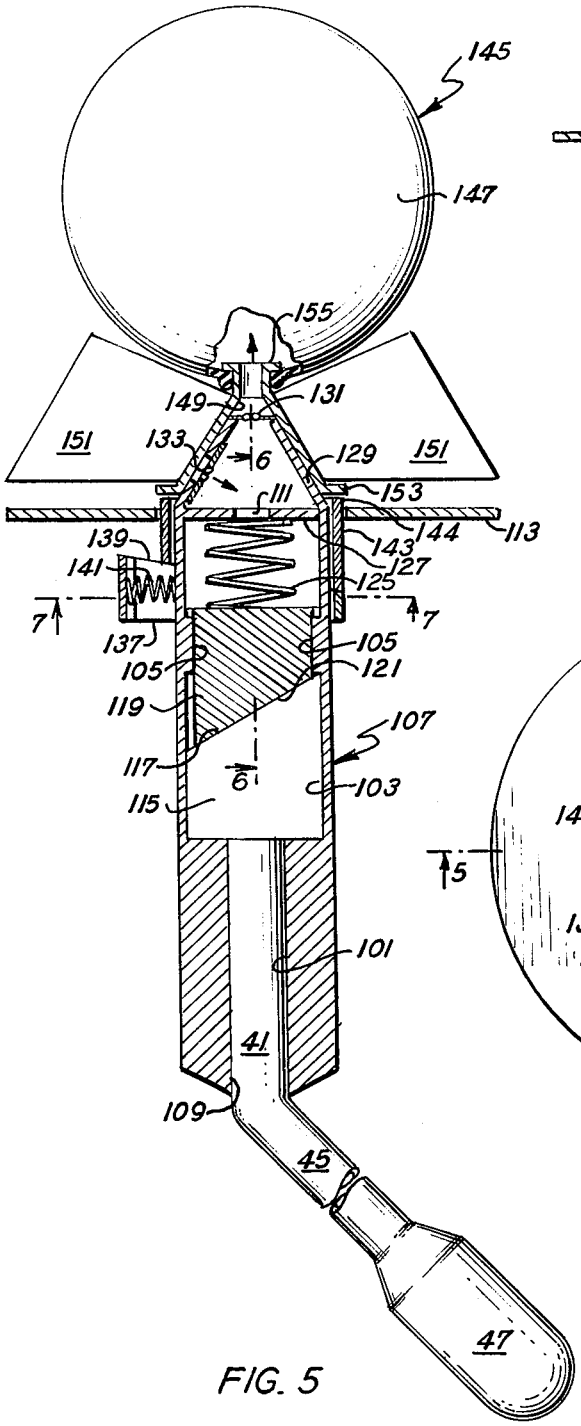
FIG. 5 is a vertical section through a second toy embodiment showing a balloon missile during inflation.
Figure 6:
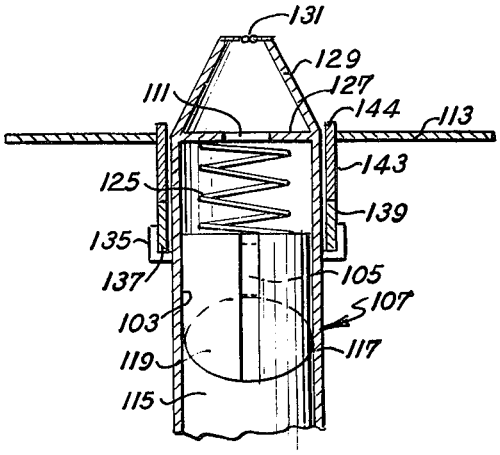
FIG. 6 is a vertical section taken along line 6—6 of FIG. 5.
Figure 7:
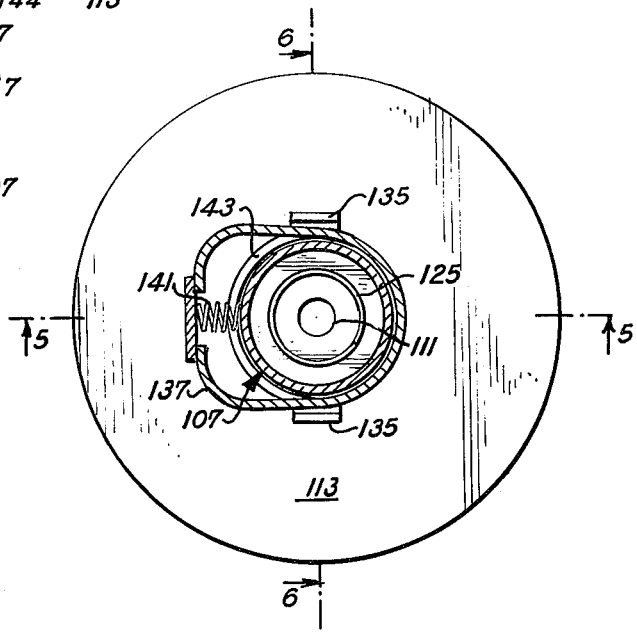
FIG. 7 is a horizontal section taken along line 7—7 of FIG. 5.

The embodiment shown in FIGS. 5–7 launches a balloon-type missile with escaping compressed air from the balloon serving to drive the missile after release from the hand held launcher. The balloon launcher has a counterweight 47, arm 45 and shaft 41, identical with similar elements of the missile launcher. Shaft 41 however rotates in small chamber 101, which opens into larger chamber 103, which is provided with guides 105, 105 on either side, the two chambers forming the interior of body 107 having a lower opening 109 and upper opening 111, terminated by circular plate 113 that extends radially outward from the body. A rotating head 115 extends upward from shaft 41 within enlarged chamber 103 and has a cam disposed upper surface 117. A reciprocating piston 119 with a lower mating cam surface 121 and guide ways corresponding to guides 105, 105, sits atop the rotating head and mates therewith at certain times. The remainder of enlarged chamber 103 encloses a compression spring 125 between the reciprocating piston 119 and the closure flange 127. A conical end 129 is provided at the top of body 107 with a one-way exit valve 131 and a one-way inlet valve 133.

Two opposed L-shaped brackets 135, 135 are fixed to the exterior walls of body 107 toward the upper end. Riding therein and surrounding said body is an oval-shaped release plunger 137 having an upper cam surface 139, and being spring biased to the left in FIG. 5 by spring 141. Riding above said release plunger is a reciprocating release ring 143 with extensions 144 that pass upwardly through plate 113.

Adapted to friction fit to cone 129 is a balloon missile 145, having a balloon 147, a female conical base 149, and a plurality of fins 151, secured to the conical base for flight stability. The conical base 149 has a lower circular flange 153 that fits immediately above reciprocating release ring extensions 144 and an upper smaller circular flange 155 about which the balloon is attached to the conical base 149. A balloon missile 145 is snugly fitted to the launcher 107 by bringing the friction mating conical surfaces 129 and 149 together.

Thereafter, body 107 is twirled which rotates handle 47 which in turn rotates head 115 and cam surface 117 against mating surface 121. Since piston 119 cannot rotate but can only reciprocate vertically, the action between the cam surfaces 117 and 121 against spring 125 causes a reciprocation movement of the piston which on the down stroke draws air through valve 133 and on the up stroke forces air through valve 131 into balloon 147. This action is continued until the balloon has been adequately inflated. Thereafter, release plunger 137 is pushed against spring 141 whereby the cam surface 139 forces release ring 143 upwardly to unseat the conical surface 149 from 129. Once this happens, the compressed air within the balloon escapes causing the missile to move rapidly upward until the compressed air is exhausted. Once the fingers are removed from release plunger 137, it is returned to the left, the release ring may be depressed and the launcher is ready to reload and repeat the sequence.

I claim:

1. A missile launching toy comprising a body adapted to be held and twirled in a hand and having a cylindrical cavity, a rotatable member mounted in one end of said cavity, a counterweight integrally attached to but extending out of said cavity from and off-center to said rotatable member whereby twirling of said body in said hand will rotate said counterweight and said rotatable member, a longitudinally movable member mounted in said cavity above, and movable by, said rotating member, means for releasably mounting a missile in said other cavity end, means contacting said missile for storing energy created by movement of said movable member, and means for simultaneously releasing said missile and said stored energy whereby said missile is launched from said body.

2. The toy of claim 1 wherein said movable member is a threaded extension of said rotatable member and is movable in a threaded portion of said cavity in said one end.

3. The toy of claim 2 wherein said energy is stored in a compressible spring positioned above said threaded extension in said cavity and contacting a missile mounted in said other cavity end.

4. The toy of claim 3 wherein said missible includes an enlarged finned head outside of said body, a long shaft attached to said head and extending into said other cavity end and contacting said spring, and a recess intermediate the missile shaft ends adapted to receive a releasable locking means to retain said missile in position while compressing said spring.

5. The toy of claim 1 wherein said movable member is a non-rotatable piston with a circular cam surface facing and spring biased against a circular cam surface of said rotating member whereby rotation of said rotating member causes reciprocation of said piston.

6. The toy of claim 5 wherein said reciprocating piston takes in air from the exterior on one stroke and compresses said air into a balloon on the reverse stroke to store said energy.

7. The toy of claim 6 wherein said body has a male conical other end adapted to frictionally engage with a female conical surface of a balloon missile attachment.

8. The toy of claim 7 with means to break said frictional engagement after compression of adequate air in said balloon.

* * * * *